US012496486B2

(12) United States Patent
Richard

(10) Patent No.: US 12,496,486 B2
(45) Date of Patent: Dec. 16, 2025

(54) MULTI-MODAL STRENGTH TRAINING APPARATUS

(71) Applicant: Jason Richard, Overland Park, KS (US)

(72) Inventor: Jason Richard, Overland Park, KS (US)

( * ) Notice: Subject to any disclaimer, the term of this patent is extended or adjusted under 35 U.S.C. 154(b) by 13 days.

(21) Appl. No.: 18/631,185

(22) Filed: Apr. 10, 2024

(65) Prior Publication Data

US 2024/0335694 A1 Oct. 10, 2024

Related U.S. Application Data

(60) Provisional application No. 63/458,270, filed on Apr. 10, 2023.

(51) Int. Cl.
*A63B 21/00* (2006.01)
*A63B 21/055* (2006.01)

(52) U.S. Cl.
CPC ..... *A63B 21/4033* (2015.10); *A63B 21/0552* (2013.01)

(58) Field of Classification Search
CPC ..... A63B 21/4033; A63B 21/0552; A63B 21/0722; A63B 21/0726; A63B 21/4009; A63B 21/4035; A63B 21/0724
See application file for complete search history.

(56) References Cited

U.S. PATENT DOCUMENTS 3,168,971 A * 2/1965 Goertzen ..... F41B 5/1461 224/916
3,450,317 A * 6/1969 Ramer ..... A45F 5/02 224/904
4,391,397 A * 7/1983 Taylor, Jr. ..... A45F 5/00 D3/315
4,638,530 A * 1/1987 Perry ..... A45F 5/021 24/3.12
D296,268 S * 6/1988 Bozarth ..... D3/229
D329,748 S * 9/1992 Ehlin ..... D3/228
5,248,072 A * 9/1993 Jones ..... B25H 3/00 224/904
5,944,242 A * 8/1999 Musarella ..... B25H 3/006 224/904
5,946,733 A * 9/1999 Spooner ..... A45F 5/06 2/160

(Continued)

*Primary Examiner* — Andrew S Lo
(74) *Attorney, Agent, or Firm* — Dale J. Ream

(57) ABSTRACT

A multi-modal strength training apparatus facilitates simultaneous use of free weights and resistance band training modalities, the apparatus including a frame body having a faceplate defining a vertically planar configuration having opposed ends and upper and lower edges. A pair of support walls extend upwardly from opposed ends, respectively, and a pair of upper receiver members each having an elongate inverted U-shaped configuration are coupled to upper ends of the support walls, respectively. The apparatus includes a pair of hook members coupled to a lower extent of the frame body and are configured to cradle or connect to a resistance band. In use, the upper receiver members are configured to receive a barbell and to avoid interference with a user's grip thereon while the faceplate defines an opening for receiving a fastener and resistance band.

14 Claims, 8 Drawing Sheets

(56) References Cited

U.S. PATENT DOCUMENTS

| | | | | |
|---|---|---|---|---|
| 6,145,717 | A * | 11/2000 | Rebeck | B25H 3/006 224/268 |
| 6,715,728 | B2 * | 4/2004 | Nielsen | A63B 21/4009 248/302 |
| 7,077,303 | B2 * | 7/2006 | Zega | B25H 3/006 224/904 |
| 7,520,844 | B1 * | 4/2009 | Flynn | A63B 21/065 482/108 |
| 9,931,532 | B2 * | 4/2018 | Castaneda | A63B 21/08 |
| 12,303,738 | B2 * | 5/2025 | Wyncott | A63B 21/078 |
| 2002/0190177 | A1 * | 12/2002 | Nielsen | A63B 21/4009 248/339 |
| 2004/0018921 | A1 * | 1/2004 | Smith | A63B 21/065 482/105 |
| 2004/0065709 | A1 * | 4/2004 | Dillenberger | B25H 3/006 224/904 |
| 2010/0062911 | A1 * | 3/2010 | Stone | A63B 21/065 482/92 |
| 2014/0256519 | A1 * | 9/2014 | Nelson | A63B 21/065 482/105 |
| 2021/0402241 | A1 * | 12/2021 | Carter | A63B 23/1227 |

* cited by examiner

MULTI-MODAL STRENGTH TRAINING APPARATUS

REFERENCE TO RELATED APPLICATIONS

This is a non-provisional patent application claiming the priority of provisional patent application 63/458,270 filed Apr. 10, 2023 titled Band Bar Accessory, which is incorporated herein by reference.

BACKGROUND OF THE INVENTION

This invention relates generally to exercise devices and, more particularly, to a multifunctional training apparatus that integrates or enables multiple weight training modalities to be used simultaneously.

For avid weightlifting enthusiasts, the desire to build strength often leads to a diverse array of training methods. From free weights to cable machines, barbells to resistance bands, each mode of training offers unique benefits for muscle development. However, integrating multiple modes of strength training simultaneously presents a challenge. For instance, trying to grip more than one type of resistance device can be cumbersome, impractical, or lead to injury. The logistical hurdle of gripping several types of equipment simultaneously can detract from the efficiency and effectiveness of the exercise routine. This challenge becomes particularly pronounced when attempting complex exercises that involve multiple muscle groups and diverse movement patterns.

Therefore, it would be desirable to have a multimodal training apparatus for enabling a user to simultaneously utilize a barbell or dumbbell and a resistance band without interfering with the user's grip on the handle portion of the barbell or dumbbell. Further, it would be desirable to have a multimodal training apparatus that includes multiple connection portals to enable resistance bands to be conveniently connected or disconnected.

SUMMARY OF THE INVENTION

Accordingly, the multi-modal strength training apparatus according to the present invention is a solution to the disadvantages faced when attempting to integrate multiple types of strength training equipment. This apparatus teaches specialized cradles for securely holding barbells, ensuring stability and comfort during lifts while not interfering with proper hand placement. Moreover, the present invention has both multiple attachment and connection openings strategically positioned to accommodate resistance bands using fasteners such as carabiners or hooks. By consolidating the handling of different resistance devices into a single accessory, weightlifters can optimize their training experience. This multifunctional attachment maximizes muscle engagement by sparing the user with the logistical complexities of equipment management.

Therefore, a general object of this invention is to provide a multi-modal strength training apparatus that enables a user to integrate multiple types of strength training equipment simultaneously.

Another object of this invention is to provide a multi-modal strength training apparatus, as aforesaid, that includes cradles and attachment apertures that enable, a user to integrate free weight training with resistance band training.

Still another object of this invention is to provide a multi-modal strength training apparatus, as aforesaid, that integrates barbell training and resistance band training without interfering with a user's proper hand position on the barbell.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
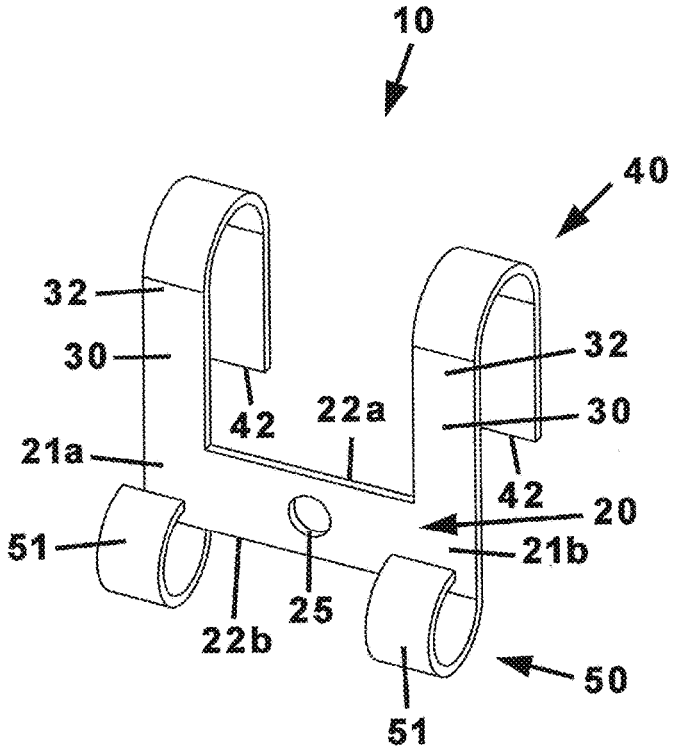
FIG. 1*a* is a perspective view of a multi-modal strength training apparatus according to the present invention.

A multi-modal strength training apparatus according to a preferred embodiment of the present invention will now be described with reference to the accompanying drawings. The multi-modal strength training apparatus 10 enables a strength training enthusiast to operate multiple exercise devices simultaneously and includes a framework having a faceplate 20, a pair of support walls 30, upper receiver members 40, and a pair of hook members 50.

The multi-modal strength training apparatus 10 is essentially a framework particularly configured to receive a free weight and providing for the connection of resistance band(s) simultaneously and without causing interference with a user's ordinary handgrip. Accordingly, the framework includes a frame body from which structures for integrated receipt or attachment of strength training devices are connected and defined. More particularly, the frame body may include a faceplate 20 defining a generally rectangular shape configuration having a pair of opposed ends 21*a*, 21*b* and opposed upper 22*a* and lower 22*b* edges extending between the pair of opposed ends. Preferably, the faceplate 20 is oriented to rest upon its lower edge 22*a* so as to define front and rear surfaces having a planar configuration. Described geometrically, the front surface of the faceplate 20 defines a vertical plane.

Further, the frame body includes a pair of support walls 30 each extending upwardly from the pair of opposed ends 21*a*, 21*b* of the faceplate 20, the pair of support walls 30 each having a flat configuration that is coplanar with the vertical plane defined by the front surface of the faceplate 20. Preferably, the pair of support walls 30 are displaced laterally from and are parallel to one another. Together, the upper edge 22*a* of the faceplate and inward edges of prospective support walls 30 define a void such that a user's handgrip on a free weight (e.g., a barbell or dumbbell 100) is not interfered with as will be described in more detail later. Further, it may be observed that the faceplate 20 and support walls 30 may have an integrated or singular construction having a generally U-shaped configuration.

In a critical aspect, the faceplate 20 may define a throughbore 25 that is preferably centered between the opposed ends 21*a*, 21*b* and which may be referred to as a receiver area or an open area. As will be discussed later, the throughbore 25 is an opening also centered between upper 22*a* and lower 22*b* edges to which a fastener 26 such as a carabiner may be coupled. The fastener 26, then, may be coupled to a resistance band 110 having an exemplary resistance as may be selected by the user.

In another aspect, the multi-modal strength training apparatus 10 may include a pair of upper receiver members 40 coupled to and extending upwardly and rearwardly from upper ends 32 of the pair of support walls 30, respectively. In one embodiment, the pair of upper receiver members 40 may be coupled to the support walls 30 using a welding process although, in another embodiment, the pair of upper receiver members 40 and the support walls 30 may have a unitary construction. Preferably, each upper receiver member 40 includes an inverted U-shaped and elongate configuration that terminates at free ends 42, respectively. It is understood that the free ends 42 are displaced rearwardly from the pair of support walls 30 and, together, define a void such that a free weight such as a barbell 100 may be received into an open area or receiver area defined thereby. In other words, the inverted U-shaped configuration of the pair of upper receiver members 40 define a receiver area capable of receiving a barbell that may be gripped and used in a generally traditional manner by a user for strength training.

Figure 2:
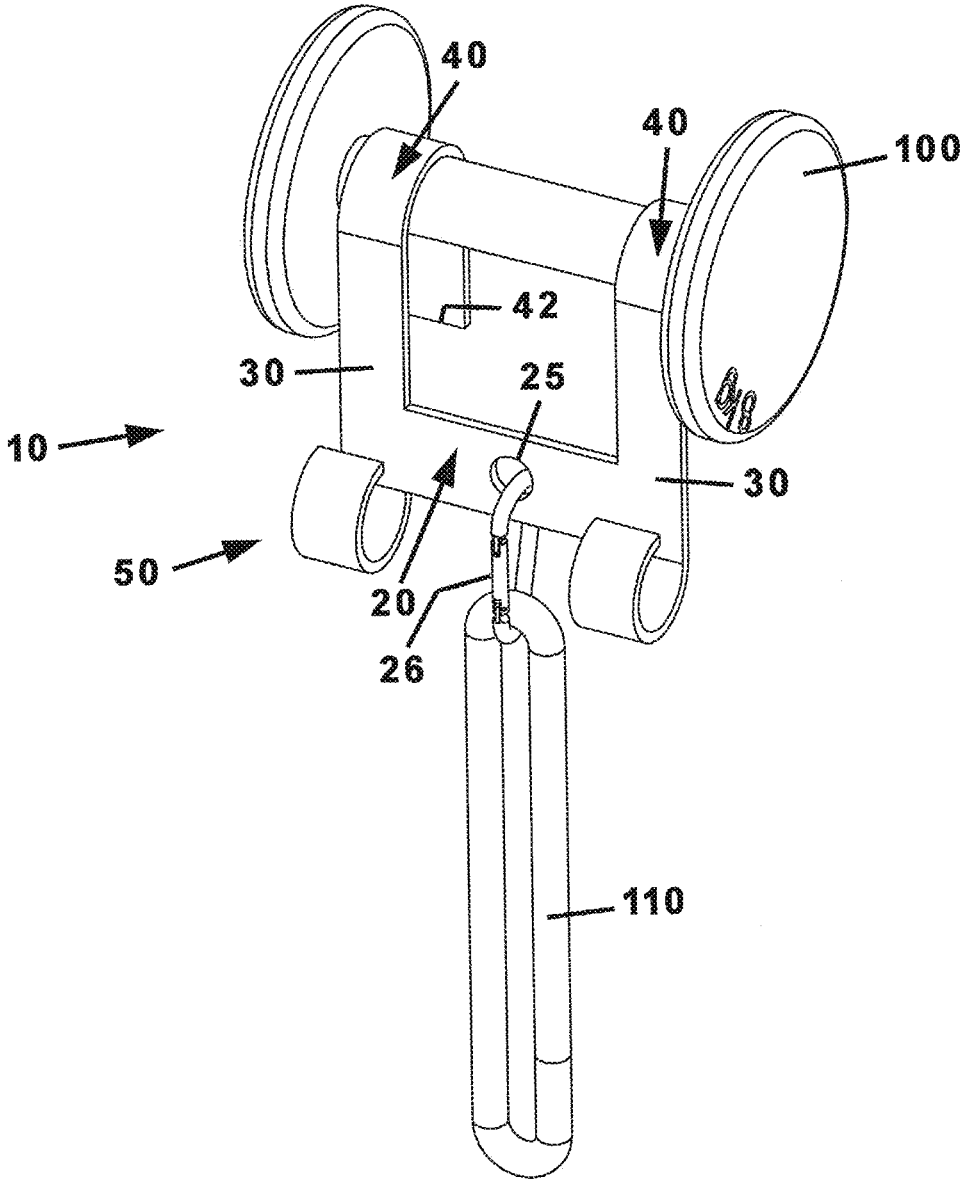
FIG. 2 is another perspective view of the training apparatus as in FIG. 1*a*, illustrated in use with a free weight and a resistance band.
Figure 3:
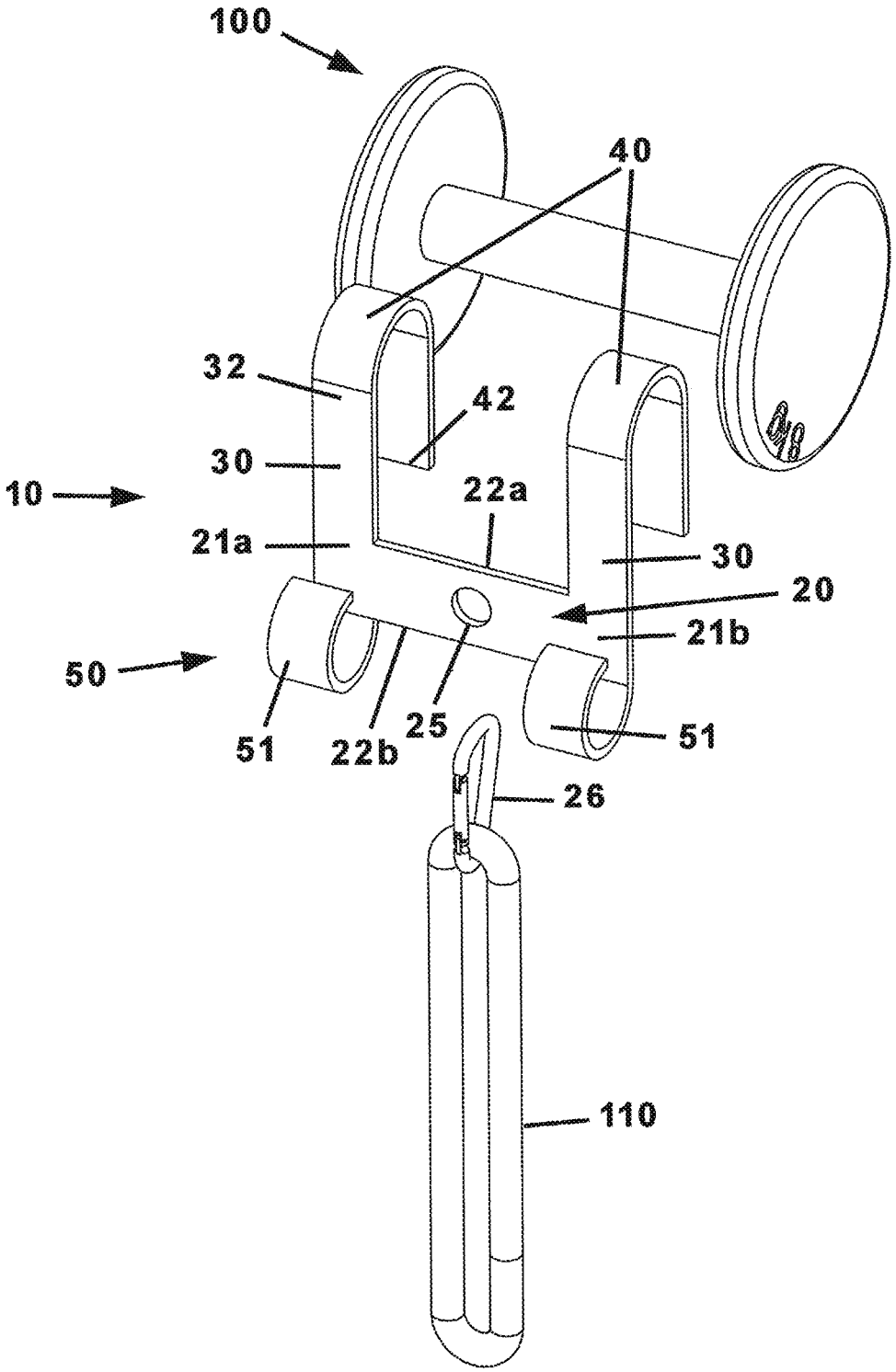
FIG. 3 is an exploded view of the training apparatus as in FIG. 2.

In still another aspect, the multi-modal strength training apparatus 10 may include a pair of hook members 50 connected to the lower edge 22*b* of the faceplate 20. Although serving a substantially similar purpose, there are two variations in construction of the pair of hook members. In one construction, each hook member 51 has a generally C-shaped configuration and acts as a cradle, the pair of hook members 51 being laterally spaced apart from one another. Each hook member 50 is coupled to and extends forwardly from the lower edge 22*b* of the faceplate 20. Further, each hook member 51 defines an opening that is complementary to and allows a resistance band 110 to be received and supported (FIGS. 1*a* and 2). It is understood that the pair of hook members 50 define what will be referred to as a receiver area or an open area for receiving a resistance band 110.

Figure 1B:
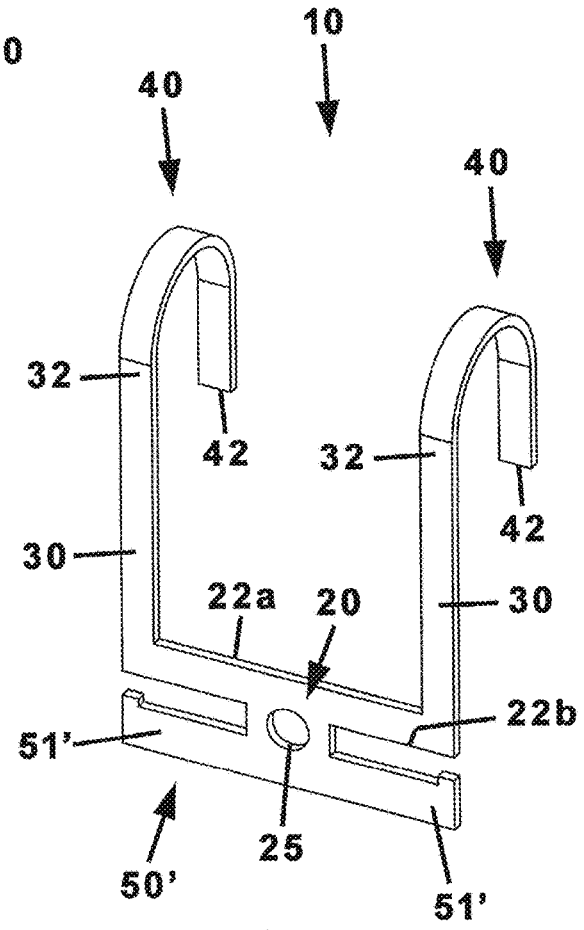
FIG. 1*b* is another perspective view of the training apparatus as in FIG. 1*a*, illustrated according to another construction variation thereof.

In another variation, the pair of hook members 50' has the character of a pair of prongs 51', each prong extending laterally away from the other prong 51' and the faceplate 20, together, define slots that are complementary to and allow a resistance band 110 to be received and supported (FIG. 1*b*). In this configuration, the pair of hook members 50' are coplanar with the vertical plane defined by the front surface of the faceplate 20. Again, the pair of hook members 50' define what will be referred to as a receiver area or an open area for receiving a resistance band 110.

Figure 4:
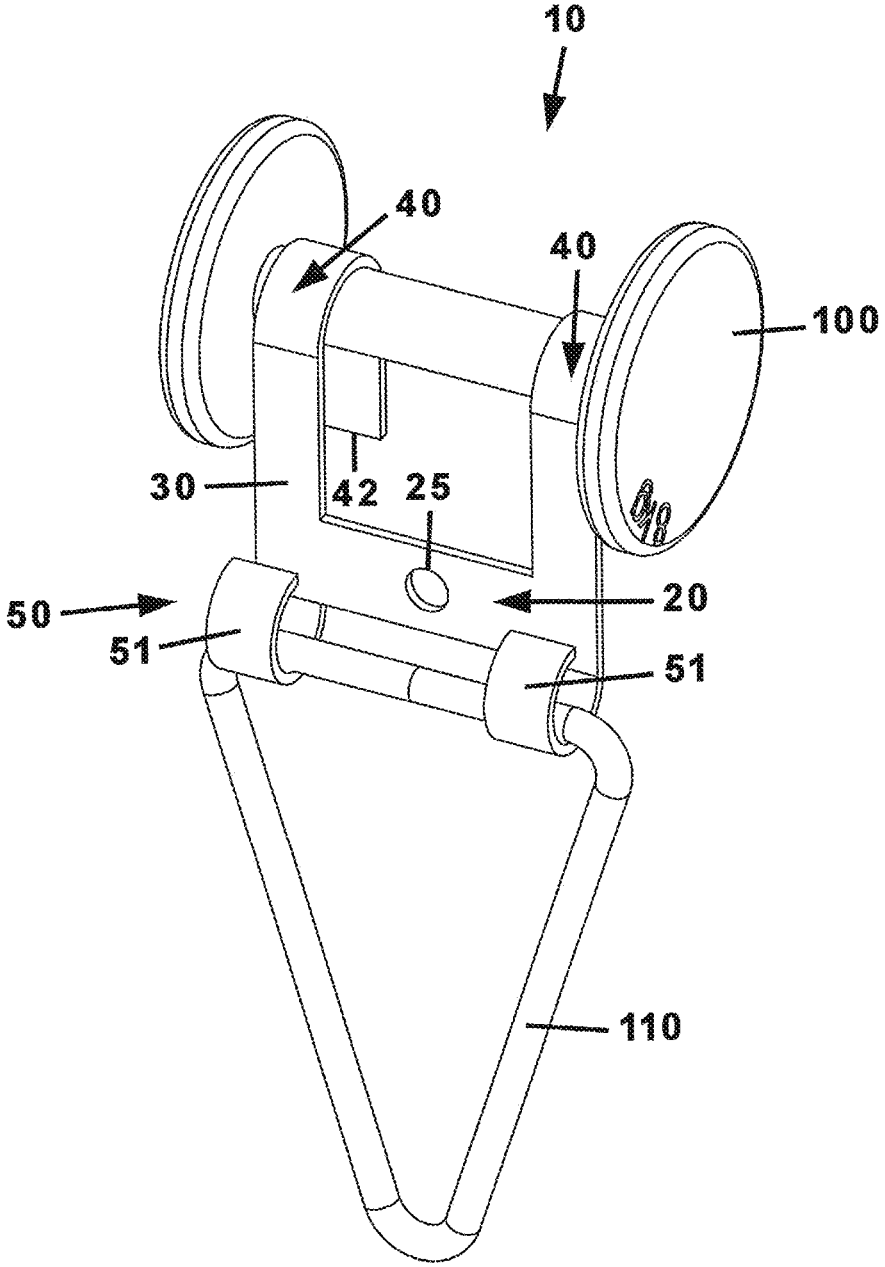
FIG. 4 is another perspective view of the training apparatus as in FIG. 2, illustrated in use with a free weight and another type of resistance band.

It can be seen that the multi-modal strength training apparatus 10 includes at least three structures that define open or receiver areas suitable for receiving a free weight 100 such as a barbell or dumbbell as well as a resistance band 110 in such a manner that both modalities of resistance can be utilized simultaneously during an exercise or workout regimen. It will be understood that these receiver areas may be referred to as a first receiver area, second receiver area, and third receiver area although the order in which they are called out is not critical and as different exercises may call for different integrations and combinations of strength training modalities. In one use, a resistance band 110 may be coupled to the faceplate aperture (also referred to as throughbore 25), such as using an interface fastener 26 such as a carabiner or the like. In another (or additional) use, a resistance band 110 may be received into and supported by the pair of hook members (FIG. 4). In still another use (or additional use), a dumbbell 100 may be lifted upwardly by a user and received into the receiver area defined by the pair of upper receiver members 30. Presumably, then, the user-gripping the handle of the dumbbell 100—may make repeated curling repetitions that must then overcome the weight of the dumbbell 110 as well as the resistance band(s) 110.

Figure 5:
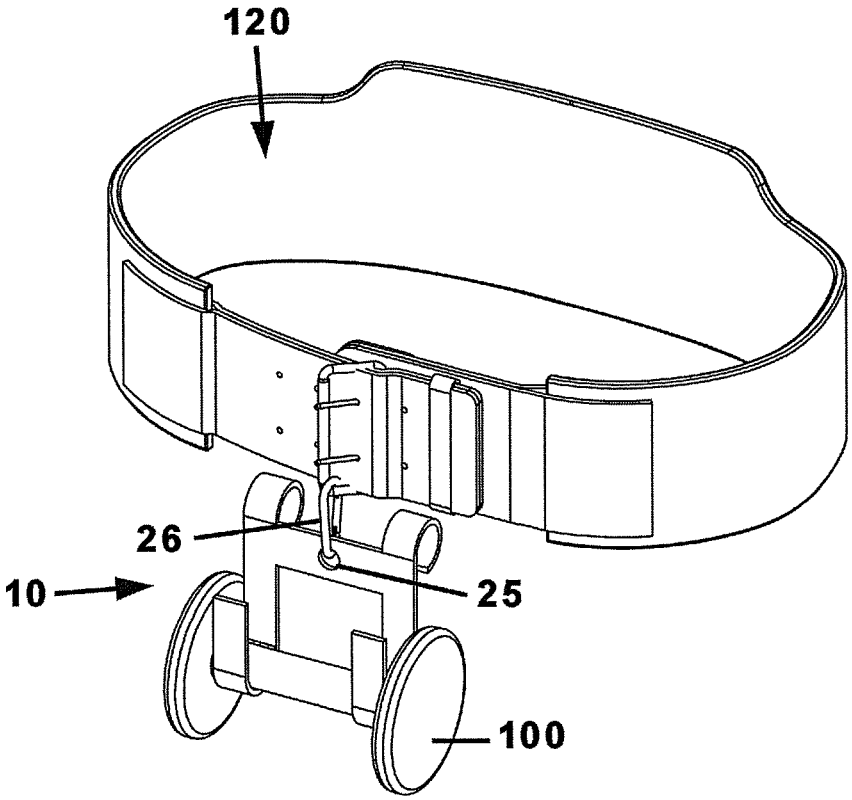
FIG. 5 is a perspective view of the training apparatus according to the present invention, illustrated in an inverted configuration and in use with a weight belt.
Figure 6:
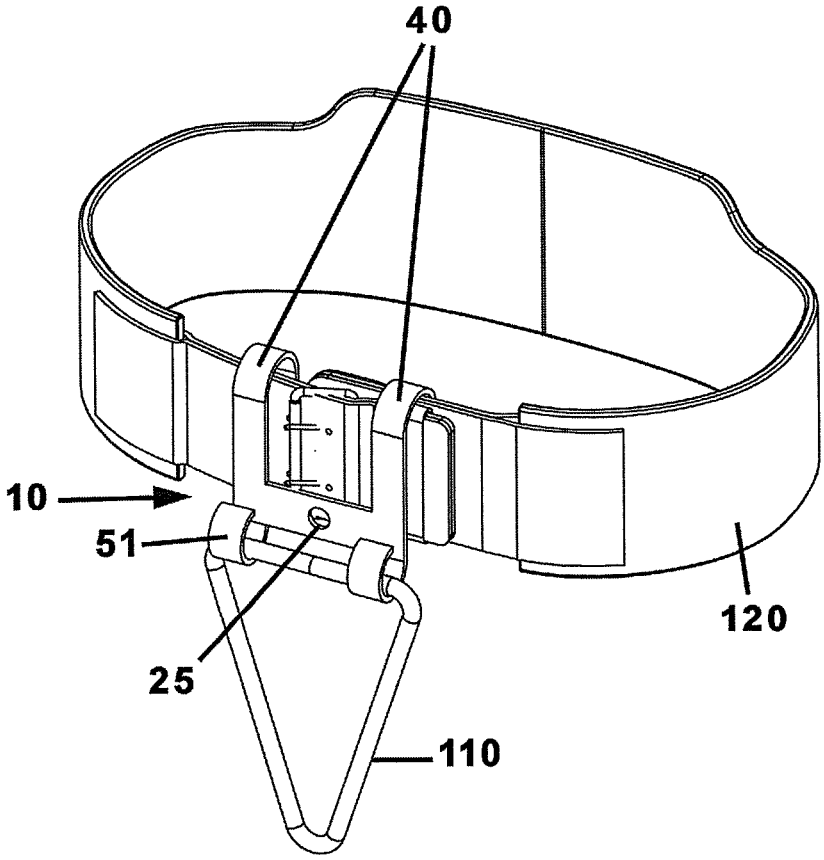
FIG. 6 is another perspective view of the training apparatus as in FIG. 5, illustrated in an upright orientation and in use with a weight belt.
Figure 7:
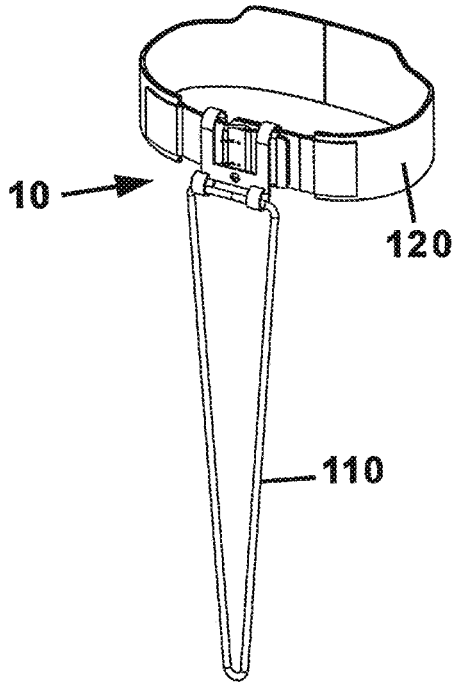
FIG. 7 is another perspective view of the training apparatus as in FIG. 6, illustrated in use with a resistance band that is stretched.
Figure 8:
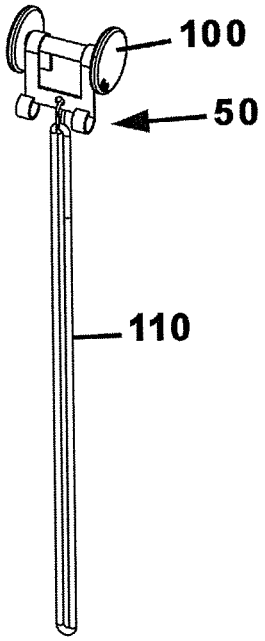
FIG. 8 is another perspective view of the training apparatus as in FIG. 7.

Additional uses of the multi-modal strength training apparatus 10 are shown in FIGS. 5 through 8. Namely, some weight training enthusiasts are likely to wear a traditional weight belt 120 to which the training apparatus 10 can be attached using a resistance belt 110 and carabiner in a manner described previously. (FIG. 5). In another use, the training apparatus 10 may be inverted, i.e., turned upside down, with regard to the description above so as to be useful in integrating even more modes of resistance training. When inverted, the upper receiver members 42 essentially become cradles into which the barbell 100 may be received and the framework may be clipped to the weight belt 120 using the fastener/carabiner 26 in conjunction with a resistance band 110 (FIG. 5). FIG. 6 illustrates how the upper receiver members 40 may be used as a halter and clasped over an upper edge of the weight belt 120. Similarly, FIG. 7 illustrates use of a resistance band 110 received by the pair of hook members 50, the resistance band 110 shown in a stress or elongate configuration as would be the case if a user was stepping on its loop end with his foot. FIG. 8 illustrates a traditional usage described earlier with a resistance band 110 being hung from a fastener 26 that is secured in the faceplate aperture such that the resistance band 110 may be coupled to a door or, again, to the user's foot.

Accordingly, the multi-modal strength training apparatus 10 enables an exercise or strength training enthusiast to combine multiple strength training resistance modalities such as free weights and resistance bands in simultaneous movements without the disadvantages of equipment management.

It is understood that while certain forms of this invention have been illustrated and described, it is not limited thereto except insofar as such limitations are included in the following claims and allowable functional equivalents thereof.

The invention claimed is:

1. A multi-modal strength training apparatus, comprising:

a frame body including a faceplate having laterally opposed ends and vertically opposed upper and lower edges extending between said laterally opposed ends, said faceplate having a planar configuration and defining a central aperture, said frame body including a pair of laterally spaced apart support walls extending upwardly from said opposed ends, respectively;

a pair of upper receiver members each being coupled to upper ends of said support walls, respectively, each having an inverted U-shaped configuration that defines a first receiver area;

a pair of hook members coupled to said faceplate and that are laterally displaced from one another.

2. The multi-modal strength training apparatus as in claim 1, wherein said upper edge of said faceplate and inner edges of said pair of support walls together define a void such that said frame body defines a U-shaped configuration.

3. The multi-modal strength training apparatus as in claim 1, wherein said pair of hook members each has a C-shaped configuration extending forwardly from said faceplate.

4. The multi-modal strength training apparatus as in claim 1, wherein said pair of hook members each defines a second receiver area.

5. The multi-modal strength training apparatus as in claim 1, wherein said pair of hook members includes a pair of attachment prongs each extending laterally outwardly and defining a second receiver area.

6. The multi-modal strength training apparatus as in claim 1, wherein said pair of upper receiver members have free ends, respectively, that are displaced from said upper ends of said support walls so as to define a void that allows access to said first receiver area, respectively.

7. The multi-modal strength training apparatus as in claim 1, wherein said central aperture has a configuration suitable for receiving a carabiner.

8. The multi-modal strength training apparatus as in claim 1, wherein said first receiver area is complementary to a configuration of a barbell and includes end panels having an elongate configuration so that said pair of support walls do not interfere with a user's grip of the barbell.

9. A multi-modal strength training apparatus that integrates simultaneous use of a barbell and a resistance band, said training apparatus comprising:

a frame body including a faceplate having laterally opposed ends and vertically opposed upper and lower edges extending between said laterally opposed ends, said faceplate having a planar configuration defining a vertical plane and defining a first open area configured to receive a fastener, said frame body including a pair of laterally spaced apart support walls extending upwardly from said opposed ends, respectively;

a pair of upper receiver members each being coupled to upper ends of said pair of support walls, respectively, each upper receiver member having an inverted U-shaped configuration that defines a second open area configured to receive the barbell; and a pair of hook members coupled to said faceplate and that are laterally displaced from one another, said pair of hook members each defining a third open area configured to receive the resistance band.

10. The multi-mode strength training apparatus as in claim 9, wherein said pair of hook members are laterally displaced from one another and are co-planer with said faceplate.

11. The multi-mode strength training apparatus as in claim 10, wherein said pair of hook members extend in opposite directions from one another and each hook member has a linear configuration defining in cooperation with said faceplate said third open area.

12. The multi-modal strength training apparatus as in claim 9, wherein said pair of hook members each has a C-shaped configuration extending forwardly from said faceplate so as to define said third open area.

13. The multi-modal strength training apparatus as in claim 9, wherein said first open area defined by said faceplate has a configuration suitable for receiving a carabiner.

14. The multi-modal strength training apparatus as in claim 9, wherein said first open area is complementary to receipt of the barbell and includes end panels having an elongate configuration so that said pair of support walls do not interfere with a user's grip of the barbell.

* * * * *